United States Patent [19]

Birch

[11] 4,128,212

[45] Dec. 5, 1978

[54] SEAM RESPONSIVE SHEAR AND METHOD

[75] Inventor: Steven W. Birch, Monroe, N.C.

[73] Assignee: Birch Brothers Southern, Inc., Waxhaw, N.C.

[21] Appl. No.: 809,427

[22] Filed: Jun. 23, 1977

[51] Int. Cl.[2] ..... B65H 19/20; B65H 17/08

[52] U.S. Cl. ..... 242/56 R; 242/66

[58] Field of Search ..... 242/56 R, 57, 66, 67.1 R, 242/76; 83/801

[56] References Cited

U.S. PATENT DOCUMENTS

| | | | |
|---|---|---|---|
| 1,211,058 | 1/1917 | Bischoff | 242/56 R |
| 2,635,826 | 4/1953 | Kuzinski | 242/57 X |
| 3,047,248 | 7/1962 | Birch | 242/56 R |
| 3,167,268 | 1/1965 | Birch | 242/56 R |
| 3,485,121 | 12/1969 | Birch | 242/56 R |
| 3,910,517 | 10/1975 | Harrison | 242/66 |

*Primary Examiner*—Edward J. McCarthy

*Attorney, Agent, or Firm*—Bell, Seltzer, Park & Gibson

[57] ABSTRACT

An apparatus and method in which lengths of web material joined by widthwise seams are guided along a path of travel adjacent a shear, either for decorative shearing or for roll winding. In the instance of decorative shearing, the web material surface is sheared to produce a particular desired effect, such as velour fabric. In winding, web material is wound into a roll of up to a first diameter at a starting winding position and then transferred to a second winding position at which winding continues to a larger diameter. The web material is controllably sheared or severed between the starting and second winding positions upon the material roll being wound at the second position reaching a desired diameter. In accordance with this invention, a plurality of seam detectors are provided and shear movement occurs in response to and in predetermined relation with sensing of a seam by all of the detectors, in order to avoid severing a seam in decorative shearing or to sever through a seam in winding.

28 Claims, 5 Drawing Figures

SEAM RESPONSIVE SHEAR AND METHOD

It is common in certain industries, including the textile industry to handle web materials such as textile fabrics in substantially continuous lengths formed by joining together a succession of shorter lengths of web material. Particularly in the textile industry, the shorter lengths of material are joined by transverse or widthwise seams formed by sewing or the like and have a thickness differing from that of the main body of web material.

The presence of such seams at spaced intervals within substantially continuous lengths of material raises certain difficulties in connection with certain web material handling processes and apparatus. One example is found in decorative shearing of textile fabrics to produce special finishes such as velour. Another example is in connection with "batching" winding of web material after a substantially continuous finishing process.

Turning first to shearing apparatus, it is conventional for textile fabric being made into velour or the like to be sheared sufficiently closely to the ground or base fabric as to sever any thickened seam passing through the shearing location. In the event that a seam is inadvertently severed, substantial production time and some material is lost by the necessity of clearing and rethreading the shear. This difficulty has been met heretofore by providing an alarm for altering a shear operator to separate the fabric from the shear so as to "jump up" the seam.

With reference to winding of web materials, it is frequently desirable to minimize web material seam waste by cutting successively wound rolls from an advancing supply of web material at or near a widthwise seam, as described in a passage beginning in Column 9 at Line 65 of U.S. Pat. No. 3,167,268 issued Jan. 26, 1965 and owned in common with this invention. While the approach described in that prior patent has been successful, it has become apparent that such winders may be further improved.

More particularly, circumstances have been encountered in which particular web materials being wound have widthwise seams which are not readily and clearly detectable or have creases or folds. In such circumstances, false indications of seam detection have occurred, leading to severance of web material at locations which permit web material seam waste to be continued at an undesirably high level. Further, even though the arrangement of U.S. Pat. No. 3,167,268 results in severance of web material near a widthwise seam location, it has been recognized that minimization of web material seam waste would be optimized where such severance occurs exactly on or through the widthwise seam.

With the aforementioned characteristics of known prior arrangements particularly in mind, it is an object of the present invention to control actuation of a shear on a web handling apparatus of the types described in such a way as to minimize machine down time and/or web material waste. In realizing this object of the present invention, a plurality of seam detectors are provided and are mounted adjacent a path of travel of web material to a shear location. Each of the detectors senses widthwise seams in web material guided along the path of travel. A control is operatively connected to the detectors and to the shear for actuating the shear in response to and in predetermined relation with seam sensing.

A further object of the present invention is to minimize web material loss in response to false indications of seam detection by requiring substantial coincidence among seam signals from all of a plurality of detectors. In realizing this object of the present invention, a distinction is drawn between signalling by all of a plurality of detectors within a predetermined interval of time and indicative of a web material widthwise seam and signalling by less than all of the detectors and indicative of false seam sensing.

A further object of the present invention is to separate a shear normally severing a surface layer from a textile fabric such as velour during passage of a seam through a shearing location. In realizing this object of the present invention, the use of an operator to respond to a warning signal is obviated.

Yet a further object of the present invention is to more accurately cut web material in or along widthwise seams. In realizing this object of the present invention, a delay is provided which is responsive to movement toward the winding positions of a length of web material equal to a distance by which seam detectors are spaced from the cutter along the path of web material travel. By means of the coordination of the delay with the length of web material and the distance between the detectors and the cutter, cutting through or at the widthwise seam is more accurately achieved.

Some of the objects having been stated, other objects will appear as the description proceeds, when taken in connection with the accompanying drawings in which —

While the present invention will be described hereinafter with particular reference to the accompanying drawings showing the invention as applied to two types of web material handling apparatus having shear means for cutting web material, it is to be understood at the outset of this description that the present invention is contemplated as having broad utility with apparatus of the general types to be described. Accordingly, the illustration and description of apparatus having certain characteristics is to be taken broadly as teaching persons skilled in the appropriate arts, and not to be taken as limiting the further utility or modification of this invention.

The web material handling apparatus and methods with which the invention is particularly described hereinafter both relate to the use of shear means. In one instance, the shear means is used for decorative shearing of textile fabric such as velour and must "jump" seams in order to avoid waste and apparatus down time. In the other instance, the shear means severs web material, possibly other than textile fabric, and must cut through seams in order to minimize waste. As will become clear hereinafter, the detectors and control means performing the functions intended for this invention may be the same. Further, the structure and operation of the present invention also has applicability to certain related web material handling apparatus not equipped with shear means but in which seams must be "jumped", such as calendars.

Figure 1:
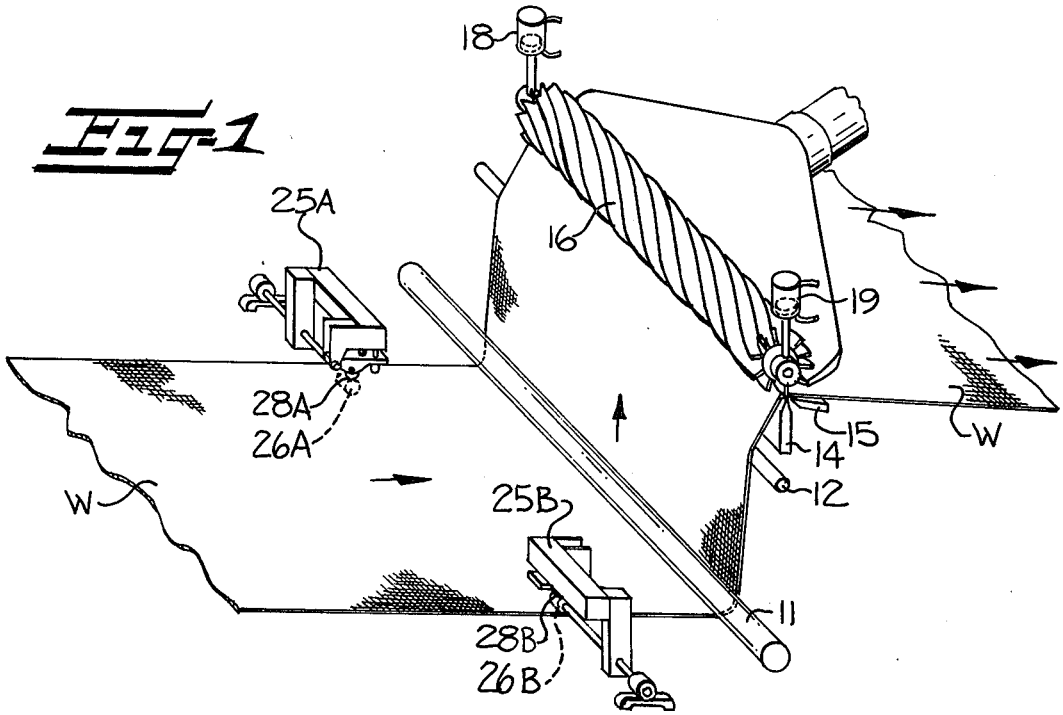
FIG. 1 is a schematic perspective view of a shearing apparatus incorporating the present invention.
Figure 2:
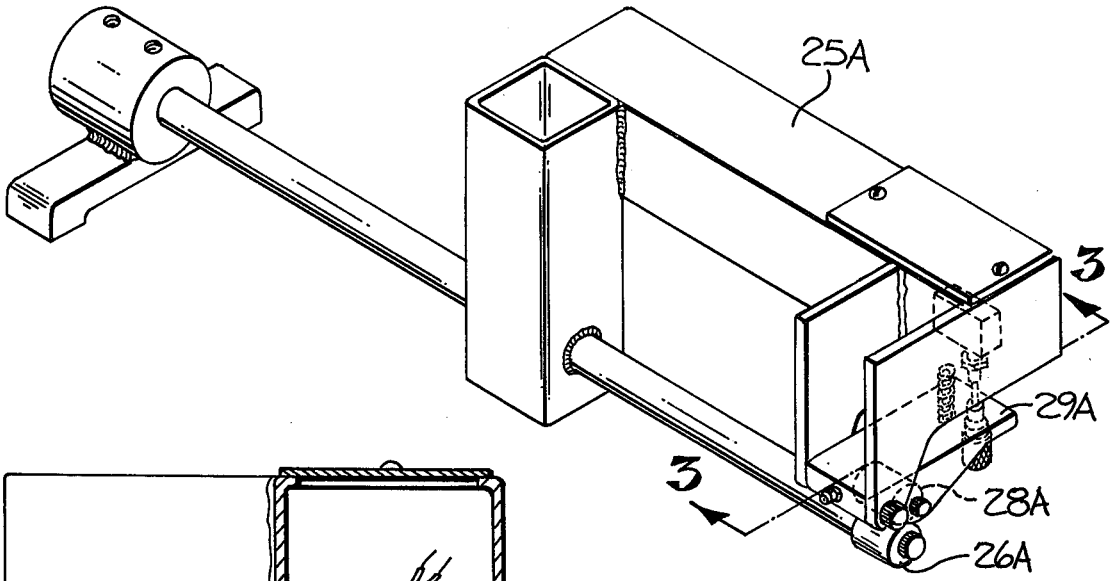
FIG. 2 is a perspective view of one seam detector as incorporated in the shear apparatus of FIG. 1.
Figure 3:
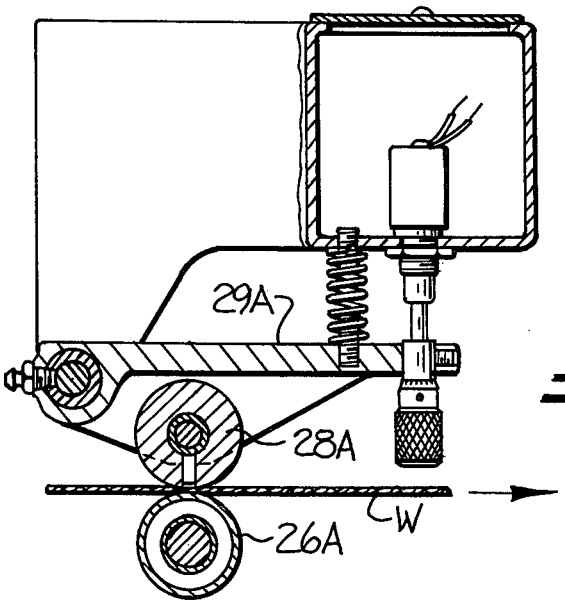
FIG. 3 is a sectional view through a portion of the detector of FIG. 2, taken generally along the line 3—3 in that figure.

Referring now more particularly to FIG. 1 a web material handling apparatus, particularly in the form of a shearing apparatus, is there generally indicated at 10. The shearing apparatus 10 has means for guiding web material W joined by widthwise seams along a path of travel while shearing a surface layer from the web material to impart a desired decorative effect. Such effects, apparatus and related methods are known to persons skilled in the applicable textile arts. These means may include guide rods or rolls 11, 12, shearing support members 14, 15 and a rotary shear knife 16. The rotary shear knife 16 and shear guides 14, 15 cooperate for forming a shear means.

In accordance with the present invention, actuating means are provided for disengaging the material W and the shear means. In the form illustrated, this means takes the form of a pair of cylinders 18, 19 acting on the rotating knife 16 to separate it from fabric passing over the shear guides 14, 15. It will be appreciated that the shear knife 16 may alternatively rotate on a fixed axis, with the shear guides 14, 15 being moved for disengagement of the shear means from the web material.

In accordance with the present invention and in order to avoid severing of a seam by the shear means, the apparatus 10 incorporates improvements which control actuation of the cylinders 18, 19. More particularly, the present invention contemplates that a plurality of seam detector means be mounted adjacent the path of travel of web material W to the shearing location, with each of the detectors sensing widthwise seams in web material guided along the path. In the particular form illustrated, a pair of seam detectors 25A, 25B are provided, each having a pair of rolls 26A, 26B, 28A, 28B, forming a nip through which the web material W passes. One of the rolls 28A, 28B is mounted on a pivoting arm 29A, 29B so as to be movable to open the nip. Upon such movement of the pivot arm 29A, 29B, an associated electrical switch is closed, thereby electrically signalling passage of a thickened portion of the web material, usually a widthwise seam. While this electromechanical form of seam detector has been chosen for illustration and description, persons skilled in the applicable arts will recognize that other sensor or detector means may be provided for responding to increased thickness or other characteristics indicative of a widthwise seam in the web material W.

Figure 4:
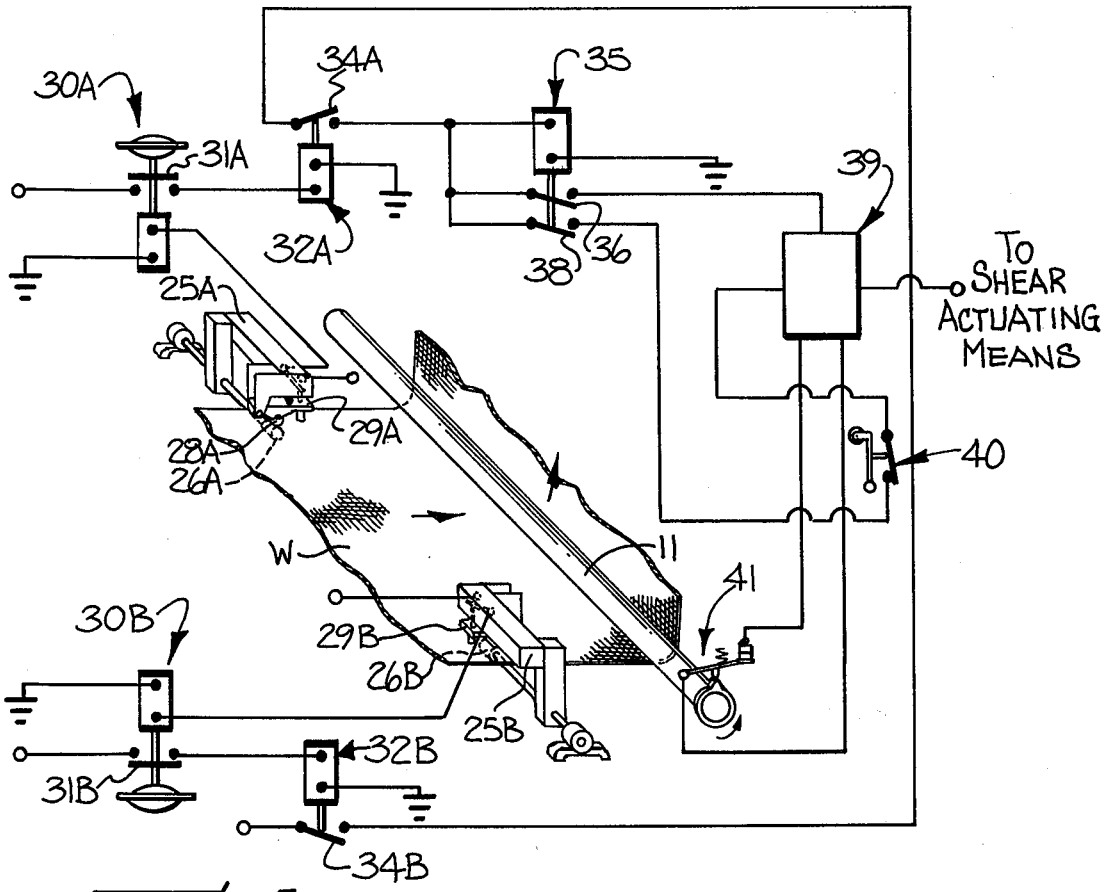
FIG. 4 is a schematic diagram of a control means for the shear apparatus of FIG. 1.

In accordance with the present invention, a control means is operatively connected to the detector means and to the shear means for actuating the shear means in response to and in predetermined relation with seam sensing by all of the detector means. In the particular form illustrated, where two seam detectors 25A, 25B are provided which electrically signal passage of a widthwise seam, the control means takes the form of an electrical circuit as schematically shown in FIG. 4. The control means comprises coincidence means for distinguishing between signalling by both of the seam detectors 25A, 25B within a predetermined interval of time and indicative of a web material widthwise seam having passed therethrough, and signalling by less than all of the detector means and indicative of false seam sensing by that one detector means. The control means additionally comprises a delay means responsive to movement toward the winding positions of a length of web material equal to a predetermined distance by which the seam detectors 25A, 25B are spaced along the path of travel of the web material W from the shearing location. The delay means is responsive to seam sensing by the detectors 25A, 25B and to web material movement for causing movement which separates the shear means and the web material W.

Referring now more particularly to FIG. 4, each of the seam detectors 25A, 25B is electrically connected with a corresponding time delay relay 30A, 30B of the type which closes promptly on completion of a circuit through the corresponding electrical switch of a seam detector but which does not reopen until passage of an adjusted, predetermined time interval on the order of one to ten seconds. Electromechanical relays of this general type are known to persons skilled in the appropriate electrical arts and accordingly need not be disclosed in full detail. Each of the time delay relays 30A, 30B has a normally open contact set 31A, 31B which respectively energize the windings of coincidence determining relays 32A, 32B. Each of the coincidence relays 32A, 32B has a normally open contact set 34A, 34B, with the normally open contact sets being electrically interconnected in series one with the other. As will be appreciated, closure of the normally open contacts 31A, 31B of the delay relays 30A, 30B coincidentially or in an overlapping time period as determined by the adjusted delay thereof will result in conductance of electrical energy through the series connected normally open contacts 34A, 34B of the coincidence relays 32A, 32B.

With completion of a circuit through the normally open contacts 34A, 34B of the coincidence relays 32A, 32B, the winding of a control relay 35 is energized and normally open contacts 36, 38 thereof energize a counter 39 and a limit switch 40 responsive to movement of the shear means. The counter 39 is electrically connected with a counting head 41 which, as described in aforementioned U.S. Pat. No. 3,167,268, constitutes a web material movement signalling means for generating pulse signals in proportion to movement of incremental lengths of web material along the path of travel to the winding positions. The counter 39, when enabled through the corresponding contact set 36 of the control relay 35, counts such number of pulse signals from the counting head 41 as represent a predetermined length of web material equal to the predetermined distance by which the seam detectors 25A, 25B are spaced along the path of web material travel from the shear means. Upon counting of such number of pulse signals, the counter 39 completes an internal electrical circuit effective for separating the shear means and the fabric being sheared. With such separating movement, the limit switch 40 operates to de-energize the winding of the control relay 35 and reset the counter 39 to a zero condition of having counted no pulse signals.

As will be appreciated, should one of the two seam detectors 25A, 25B falsely signal detection of a widthwise seam, only one of the coincidence relays 32A, 32B would be energized. Due to the series connection of the normally open contacts 34A, 34B thereof, the winding of the control relay 35 would not be energized and the counter 39 would not be enabled to respond to the counting head 41 by calling for actuation of the cutting means. Further, it will be appreciated that the delay accomplished by the time delay relays 30A, 30B permits jumping a seam in web material W even under circunstances where a seam is skewed and not in a truly transverse position widthwise of the web material. That is, signalling by a first one of the seam detectors 25A, 25B establishes the beginning of a predetermined time period (mentioned above as being up to 10 seconds) within which signalling by the other of the seam detectors 25A, 25B will lead to completion of the circuit energizing the control relay 35 and consequent operation of the shear means in predetermined relation with signalling of the sensing of a seam. Conversely, failure of the other seam detector to signal within the time period leads to an automatic resetting or recycling of the control on expiration of the time period.

Figure 5:
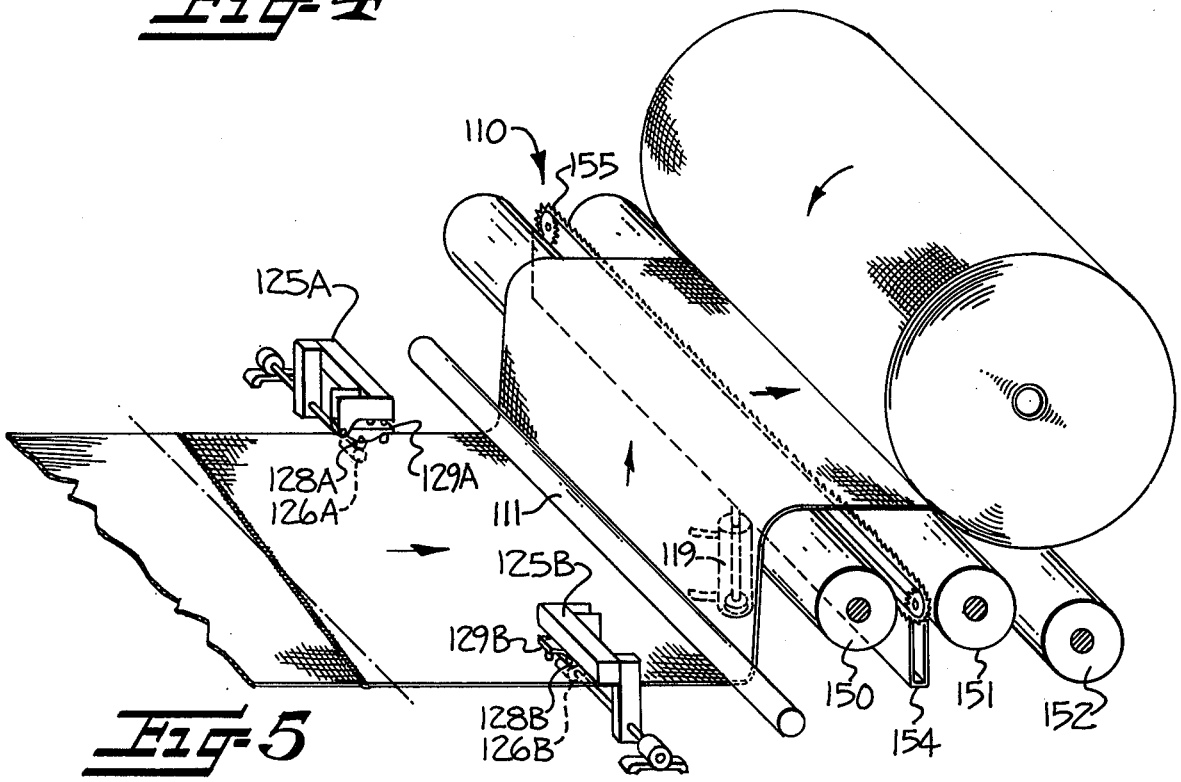
FIG. 5 is a perspective view of a web winding apparatus incorporating the present invention.

As mentioned hereinabove, the present invention, in addition to being useful in decorative shearing apparatus, is useful in conjunction with web material handling apparatus for winding successive rolls from a supply of web material. A web winding apparatus embodying the present invention is illustrated in FIG. 5, where structural elements corresponding generally to elements illustrated in FIGS. 1 through 4 have been identified by similar reference characters of a one hundred series. For purposes of brevity, the full discussion given above will not be repeated, and the discussion which follows will be directed particularly to the points of distinction between the web winding apparatus of FIG. 5 and the shearing apparatus of FIG. 1.

In similarity to the winder of aforementioned prior U.S. Pat. No. 3,167,268, the winding apparatus 110 has a plurality of elongate driving rolls 150, 151, 152 which cooperate for supporting a roll of web material at a starting or first winding position and in engagement with one driving roll 150 during initiation of winding. The roll is then transferred by transfer means to a second winding position (as shown in FIG. 5) and into engagement with another driving roll 151 during continuation of winding.

The apparatus 110 has shear means movable transversely of the web material between the starting and second winding positions for controllably severing web material upon the web material roll being wound at the second position reaching a desired diameter. The transversely movable shear means includes a carriage 154 which is supported by the frame of the apparatus 110 for movement from a withdrawn position on one side of the path of travel of the web material W to an extended position on the other side thereof. In the form illustrated and as described in the aforementioned related patent, the carriage moves vertically upwardly from a position below the web material W to a position thereabove. Such movement is accomplished by appropriate actuators, such as an expansible chamber device 119. The carriage 154 preferably supports a moving chain cutter 155, and the carriage may additionally support means for directing a leading edge of web material about a core.

The winding apparatus 110 uses a pair of seam detectors 125A, 125B as described above to control actuation of the shear means in such a manner as to sever successive rolls by cutting through seams. Such cutting through seams will be recognized as facilitating minimization of seam waste.

In the drawings and specification, there has been set forth a preferred embodiment of the invention, and although specific terms are employed, they are used in a generic and descriptive sense only and not for purposes of limitation.

That which is claimed is:

1. In a web material handling apparatus having means for guiding lengths of web material joined by widthwise seams along a path of travel, and shear means for cutting web material at a predetermined position along the path of travel, an improvement which controls shear means actuation so as to minimize web material waste and comprising: a plurality of seam detector means mounted adjacent said path of travel, upstream of said shear means position, each for sensing widthwise seams in web material guided along said path of travel toward said shear means position; and control means operatively connected to said detector means and to said shear means for moving said shear means relative to web material in response to and in predetermined relation with seam sensing by all of said detector means.

2. Apparatus according to claim 1 wherein said detector means are spaced at a predetermined distance along said path of travel from said shear means and further wherein said control means comprises delay means responsive to movement toward said shear position of a length of web material equal to said predetermined distance and to seam sensing by all said detector means for moving said shear means upon movement of a sensed seam from said detector means to said shear means.

3. Apparatus according to claim 2 wherein said delay means comprises web material movement signalling means for generating pulse signals in proportion to movement of incremental lengths of web material along said path of travel, and counter means responsive to said detector means and to said signalling means for counting such number of pulse signals as represent said predetermined length of web material.

4. Apparatus according to claim 1 wherein said detector means signal in response to seam sensing and further wherein said control means comprises coincidence means for distinguishing between signalling by all of said detector means within a predetermined interval of time and indicative of sensing of a web material widthwise seam and signalling by less than all of said detector means and indicative of a false seam sensing signal.

5. Apparatus according to claim 4 wherein said coincidence means comprises timer means responsive to signalling by a first actuated detector means for timing said predetermined interval of time and means responsive to said timer means for permitting a later actuated detector means to actuate said cutting means.

6. In a shearing apparatus for web material such as textile fabric and having means for guiding lengths of web material joined by widthwise seams along a path of travel, and shear means for severing a surface layer from web material at a predetermined position along the path of travel, an improvement which controls shear means actuation so as to minimize web material waste and comprising: a plurality of seam detector means mounted adjacent said path of travel upstream of said shear means position, each for sensing widthwise seams in web material guided along said path of travel toward said shear position; and control means operatively connected to said detector means and to said shear means for separating said shear means from web material in response to and in predetermined relation with seam sensing by all of said detector means.

7. In a web winding apparatus having means for guiding lengths of web material joined by widthwise seams along a path of travel while winding the web material into a roll of up to a first diameter at a starting winding position and continuing winding of the web material roll to a larger diameter at a second winding position, transfer means for transferring a web material roll from the starting winding position to the second winding position, and web cutting means for controllably severing web material between the starting and second winding positions upon the web material roll being wound at the second position reaching a desired diameter, an improvement which controls cutting means actuation so as to minimize web material seam waste and comprising: a plurality of seam detector means mounted adjacent said path of travel, each for sensing widthwise seams in web material guided along said path of travel toward said winding positions; and control means operatively connected to said detector means and to said cutting means for actuating said cutting means in response to and in predetermined relation with seam sensing by all of said detector means.

8. In a shearing apparatus for textile fabric and having means for guiding lengths of fabric joined by widthwise seams along a path of travel, and shear means for severing a surface layer from the fabric at a predetermined shearing position along the path, an improvement comprising: a plurality of detector means mounted adjacent said path of travel, each for signalling electrically the passage thereby of widthwise seams in fabric guided along said path of travel toward said shearing position, coincidence circuit means electrically connected to said detector means for distinguishing between signalling by all of said detector means within a predetermined interval of time and indicative of the passage of a widthwise seam and signalling by less than all of said detector means and indicative of a false signal from at least one detector means, and control relay means electrically connected to said coincidence circuit means and operatively connected to said shear means for separating said shear means from the fabric in response to signalling by all of said detector means.

9. Apparatus according to claim 8 wherein said detector means comprise a pair of detectors mounted adjacent respective marginal side edge portions of said path of travel and algined transversely of web material moving therealong.

10. Apparatus according to claim 8 wherein said detector means comprise means for sensing variations in thickness of web material as indicative of passage of a widthwise seam.

11. Apparatus according to claim 10 wherein said detector means comprise a pair of rolls defining a nip for passage of web material therethrough and electrical switch means responsive to increased separation of said rolls by passage of a thickened seam therebetween for electrically signalling sensing of a seam.

12. In a web winding apparatus having means for guiding lengths of web material joined by widthwise seams along a path of travel while winding the web material into a roll of up to a first diameter at a starting winding position and continuing winding of the web material roll to a larger diameter at a second winding position, transfer means for transferring a web material roll from the starting winding position to the second winding position, and web cutting means for controllably severing web material between the starting and second winding positions upon the web material roll being wound at the second position reaching a desired diameter, an improvement comprising: a plurality of detector means mounted adjacent said path of travel, each for signalling electrically the passage thereby of widthwise seams in web material guided along said path of travel toward said winding positions, coincidence circuit means electrically connected to said detector means for distinguishing between signalling by all of said detector means within a predetermined interval of time and indicative of the passage of a widthwise seam and signalling by less than all of said detector means and indicative of a false signal from at least one detector means, and control relay means electrically connected to said coincidence circuit means and operatively connected to said cutting means for actuating said cutting means in response to signalling by all of said detector means.

13. Apparatus according to claim 12 wherein said detector means comprise a pair of detectors mounted adjacent respective marginal side edge portions of said path of travel and aligned transversely of web material moving therealong.

14. Apparatus according to claim 12 wherein said detector means comprise means for sensing variations in thickness of web material as indicative of passage of a widthwise seam.

15. Apparatus according to claim 14 wherein said detector means comprise a pair of rolls defining a nip for passage of web material therethrough and electrical switch means responsive to increased separation of said rolls by passage of a thickened seam therebetween for electrically signalling sensing of a seam.

16. In a shearing apparatus for textile fabric and having means for guiding lengths of fabric joined by widthwise seams along a path of travel, and shear means for cutting the fabric at a predetermined shearing position along the path of travel, an improvement comprising: a plurality of detector means mounted adjacent said path of travel at a predetermined distance therealong from said shear means, each for signalling the passage thereby of widthwise seams in fabric guided along said path of travel toward said shearing position, coincidence means operatively connected to said detector means for distinguishing between signalling by all of said detectormeans within a predetermined interval of time and indicative of the passage of a widthwise seam and signalling by less than all of said detector means and indicative of a false signal from at least one detector means, and shear actuation delay means operatively connected to said coincidence means and said shear means and responsive to the passage of a widthwise seam and movement toward said shearing position of a length of fabric equal to said predetermined distance for actuating said shear means to disengage from fabric adjacent a seam.

17. In a web winding apparatus having means for guiding lengths of web material joined by widthwise seams along a path of travel while winding the web material into a roll of up to a first diameter at a starting winding position and continuing winding of the web material roll to a larger diameter at a second winding position, transfer means for transferring a web material roll from the starting winding position to the second winding position, and web cutting means for controllably severing web material between the starting and second winding positions upon the web material roll being wound at the second position reaching a desired diameter an improvement comprising: a plurality of detector means mounted adjacent said path of travel at a predetermined distance therealong from said cutting means, each for signalling the passage thereby of widthwise seams in web material guided along said path of travel toward said winding positions, coincidence means operatively connected to said detector means for distinguishing between signalling by all of said detector means within a predetermined interval of time and indicative of the passage of a widthwise seam and signalling by less than all of said detector means and indicative of a false signal from at least one detector means, and cutting actuation delay means operatively connected to said coincidence means and said cutting means and responsive to the passage of a widthwise seam and movement toward said winding positions of a length of web material equal to said predetermined distance for actuating said cutting means to sever web material closely adjacent a seam.

18. In a method of handling lengths of web material joined by widthwise seams which includes guiding the material along a path of travel adjacent a shear, and shearing the material, an improvement comprising sensing at a plurality of points along the path of travel the passage of a widthwise seam, and responding to and in predetermined relation with the sensing of a seam at all of the points by causing relative movement between the shear and the material.

19. In a method of decoratively shearing lengths of textile fabric joined by widthwise seams which includes guiding the fabric along a path of travel adjacent a shear and shearing a surface layer from the fabric, an improvement comprising sensing at a plurality of points along the path of travel the passage of a widthwise seam, and responding to and in predetermined relation with the sensing of a seam at all of the points by separating the shear and the fabric in the area of the seam.

20. In a method of winding lengths of web material joined by widthwise seams which includes guiding the material along a path of travel, winding the material into a roll of up to a first diameter at a starting winding position, transferring the roll from the starting winding position to a second winding position, continuing winding the roll up to a larger diameter at the second winding position, and thereafter severing the material between the starting and second winding positions upon the roll being wound to a desired diameter, an improvement comprising: sensing at a plurality of points along the path of travel the passage of a widthwise seam, and responding to and in predetermined relation with the sensing of a seam at all of the points by severing the material substantially through the seam.

21. In a method of handling lengths of web material joined by widthwise seams which includes guiding the material along a path of travel adjacent a shear and shearing the material, an improvement comprising electrically signalling the passage of a widthwise seam by a plurality of points along the path of travel, distinguishing between signalling from all of the points and indicative of the passage of a seam and signalling from less than all of the points and indicative of false seam signalling, and responding to and in predetermined relation with the distinguished passage of a seam by causing relative movement between the shear and the material.

22. A method according to claim 21 for decorative shearing of textile fabric and wherein the step of shearing comprises cutting a surface layer from a textile fabric and the step of responding to passage of a seam comprises disengaging the shear from the fabric in the area of the seam.

23. A method according to claim 21 for winding rolls of web material and wherein the step of shearing comprises severing web material at a shear position and the step of responding to passage of a seam comprises moving the shear to intersect and pass through the web material in the area of the seam.

24. In a method of handling lengths of web material joined by widthwise seams which includes guiding the material along a path of travel adjacent a shear, and shearing the material, an improvement comprising sensing the passage of a widthwise seam at a point along the path of travel spaced at a predetermined distance from the shear, responding to the sensed passage of a seam by measuring the length of material moving along the path, and moving the shear relative to the material in response to the measured length of material equaling the predetermined distance.

25. In a method of decoratively shearing lengths of textile fabric joined by widthwise seams which includes guiding the fabric along a path of travel adjacent a shear and shearing a surface layer from the fabric, an improvement comprising sensing the passage of a widthwise seam at a point along the path of travel spaced at a predetermined distance from the shear, responding to the sensed passage of a seam by measuring the lengths of material moving along the path, and disengaging the shear from the fabric in response to the measured length of material equaling the predetermined distance.

26. In a method of winding lengths of web material joined by widthwise seams which includes guiding the material along a path of travel, winding the material into a roll of up to a first diameter at a starting winding position, transferring the roll from the starting winding position to a second winding position, continuing winding the roll up to a larger diameter at the second winding position, and thereafter severing the material between the starting and second winding positions upon the roll being wound to a desired diameter, an improvement comprising: sensing the passage of a widthwise seam at a point along the path of travel spaced at a predetermined distance from the point of material severing, responding to the sensed passage of a seam by measuring the length of material moving along the path, and severing the material in response to the measured length of material equaling the predetermined distance and substantially through the sensed seam.

27. In a web material handling apparatus having means for guiding lengths of web material joined by widthwise seams along a path of travel, and rotary means spanning the width of the material for engaging web material at a predetermined position along the path of travel, an improvement which controls actuation of the rotary means so as to minimize web material waste and comprising: a plurality of seam detector means mounted adjacent said path of travel, upstream of said rotary means position, each for sensing widthwise seams in web material guided along said path of travel toward said rotary means position; and control means operatively connected to said detector means and to said rotary means for moving said rotary means away from web material in response to and in predetermined relation with seam sensing by all of said detector means.

28. In a method of handling lengths of web material joined by widthwise seams which includes guiding the material along a path of travel adjacent a rotary element and engaging the material with the rotary element, an improvement comprising sensing at a plurality of points along the path of travel the passage of a widthwise seam, and responding to and in predetermined relation with the sensing of a seam at all of the points by causing the rotary element to move away from the material.

* * * * *